United States Patent [19]

Howe

[11] 4,335,542

[45] Jun. 22, 1982

[54] COMBINATION BELT AND DISK SANDER MACHINE

[76] Inventor: Floyd M. Howe, 5201 Arcade Ave., NE., Salem, Oreg. 97303

[21] Appl. No.: 150,997

[22] Filed: May 19, 1980

[51] Int. Cl.[3] ..... B24B 21/10; B24B 21/18

[52] U.S. Cl. ..... 51/3; 51/135 BT; 51/148

[58] Field of Search ..... 51/3, 135 R, 135 BT, 51/148

[56] References Cited

U.S. PATENT DOCUMENTS

| | | | |
|---|---|---|---|
| 2,055,351 | 9/1936 | Hormel | 51/135 R |
| 2,449,519 | 9/1948 | Sutton | 51/135 BT |
| 2,780,897 | 2/1957 | Radase | 51/3 X |
| 2,832,179 | 4/1958 | Beltram | 51/135 R |
| 3,538,650 | 11/1970 | Pollak | 51/148 |

FOREIGN PATENT DOCUMENTS

| | | | |
|---|---|---|---|
| 936617 | 12/1955 | Fed. Rep. of Germany | 51/148 |

*Primary Examiner*—Nicholas P. Godici

*Attorney, Agent, or Firm*—James D. Givnan, Jr.

[57] ABSTRACT

An abrading machine having a main body of elongate shape with an abrading belt extending therealong and supported by rolls adjacent each end of the main body. A roll mounting assembly in place on the main body carries one of the rolls and is normally in a spring biased position to assure proper belt tensioning. The mounting assembly includes a roll carrying spindle and a spindle adjustment for purpose of proper belt tracking on the roll. The mounting assembly also includes a roll release lever for temporarily retracting the roll during belt replacement. The main body of the machine defines laterally orientated openings facilitating belt removal. A power output shaft is coupled to one of the belt carrying rolls and further powers an abrading disk affixed to the shaft end. A tool bed is offset from the disk.

5 Claims, 4 Drawing Figures

COMBINATION BELT AND DISK SANDER MACHINE

BACKGROUND OF THE INVENTION

The present application pertains generally to abrading machines and more particularly to such a machine having both belt and disk components.

It is acknowledged that within the prior art are abrading machines which provide both rotary abrading or sanding disks and an abrading belt to permit the user to perform different abrading operations on the one machine. Broadly speaking, such combinations are found in U.S. Pat. Nos. 1,259,494; 1,519,425; 1,484,706; 1,153,479 and 3,137,105.

Of the aforementioned patents, U.S. Pat. No. 1,519,425 is pertinent in that it discloses a grinding wheel carried by a shaft which shaft has an enlarged segment on which is entrained a series of abrading belts. U.S. Pat. No. 3,137,105 discloses a motor output shaft on the end of which is affixed a grinding wheel with a shaft mounted drive roll driving an entrained abrasive belt.

SUMMARY OF THE PRESENT INVENTION

The present invention is embodied within an abrading machine providing both belt and disk components and a novel arrangement for positioning a belt carrying roll to facilitate belt alignment and/or removal.

At opposite ends of an elongate main body are rolls on which an abrading belt is carried. One of said rolls is carried on a spindle the camber of which is adjustable about an upright axis. A roll mounting assembly including the spindle is movably mounted on the machine main body and is normally spring biased to a belt tensioning position. A roll release lever is provided for locking the assembly in a retracted position during belt replacement. A tool bed is removably mounted to facilitate abrading disk replacement while an opening in the elongate body permits lateral passage of the abrading belt during replacement of same.

Important objectives of the present machine include the provision of a compact abrading machine providing both belt and disk abrading components supported by a main body which may be conveniently supported by a motor housing; the provision of an abrading machine wherein a tail roll is adjustably mounted for fore and aft biased movement to tension an abrading belt and further includes a pivoted spindle enabling camber positioning of the roll for belt tracking purposes; the provision of an abrading machine having a driven belt carrying roll which includes a replaceable resilient surface providing desired frictional engagement with the entrained abrading belt; the provision of an abrading machine providing an elongate belt supporting surface permitting the abrading of edges of considerable length; the provision of an abrading machine having a tail roll mounting assembly which may be unitarily retracted against spring components facilitating belt replacement; the provision of an abrading machine having a main body with laterally directed openings permitting unobstructed removal and replacement of the belt.

DETAILED DESCRIPTION OF THE PREFERRED EMBODIMENT

Figure 1:
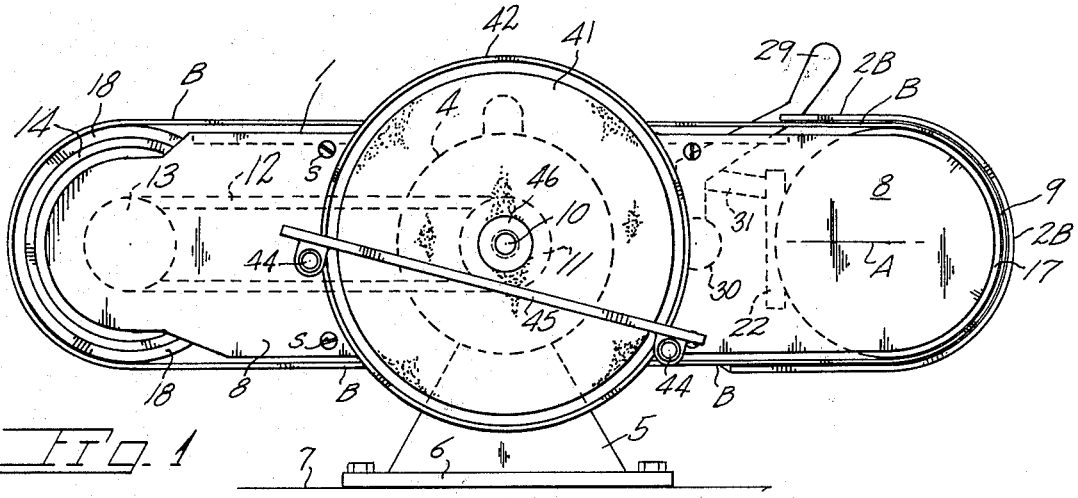
FIG. 1 is a front elevational view of the present abrading machine.
Figure 2:
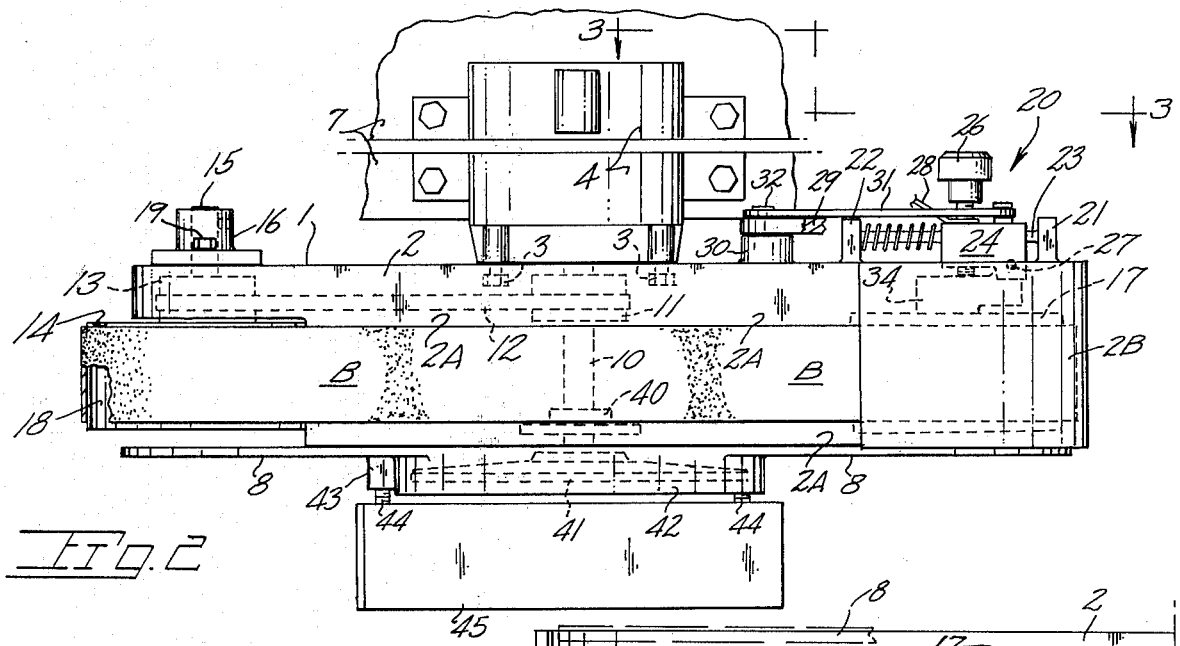
FIG. 2 is a plan view of FIG. 1 with the electric motor sectioned for convenience of illustration.

With continuing attention to the drawing wherein applied reference numerals indicate parts similarly hereinafter identified, the reference numeral 1 indicates the main body of the present machine which body is of elongate configuration comprising a casting 2 conveniently adapted for bolted securement at 3 to the face of a motor 4. A motor pedestal at 5 is carried by a base plate 6 in place on a supporting surface 7.

With attention again to elongate main body 1, casting 2 includes an upper surface 2A which is of substantial length (eighteen inches in one embodiment) to support the upper run of an abrading belt B. Said casting is additionally interiorly provided with threaded bosses (not shown) to receive screws S securing a cover plate 8 of the main body. An opening at 9 is of slotted configuration defined by a raised portion 2B of casting 2 and the end of cover plate 8.

A motor output shaft at 10 is provided with a drive pulley 11 on which is entrained a V-belt 12 driving a hub 13 of a drive wheel 14. A spindle at 15 for hub 13 is suitably mounted to casting 2 by a boss 16 which may be positioned fore and aft in an opening in the casting wall and secured by fasteners 19. A resilient tread 18 is on roll 14.

At the opposite end of main body 1 is a tail roll 17 which serves to tension belt B. A tail roll mounting assembly is indicated generally at 20 which assembly is adapted for fore and aft movement along casting 2 parallel to the lengthwise axis A of said casting. Additional provision is made for movement of a spindle component of the assembly about an upright axis to enable proper roll camber for desired tracking of the belt on the crowned tail roll. Flanges at 21 and 22 on casting 2 mount a pair of slides 23 which in turn receive a suitably bored spindle carrier block 24. Spiral springs 25 bias said block outwardly toward the adjacent end of the main body. Said block is internally threaded crosswise to receive a tail roll adjustment screw 26 suitably provided with a fingergrip at its outer end. Advancement of screw 26 imparts arcuate movement to tail roll 17 about an upright pivot pin 27 for camber adjustment of same. A screw lock is at 28.

Figure 3:
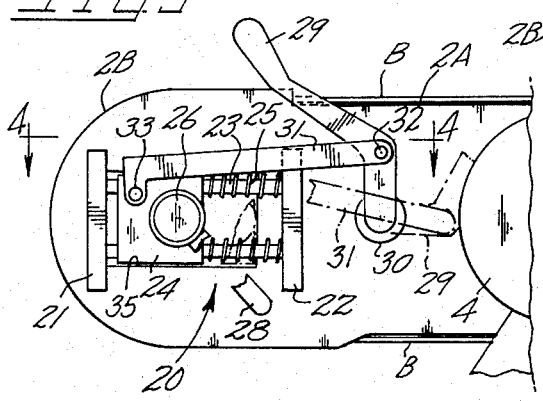
FIG. 3 is an elevational view taken along line 3—3 of FIG. 2.
Figure 4:
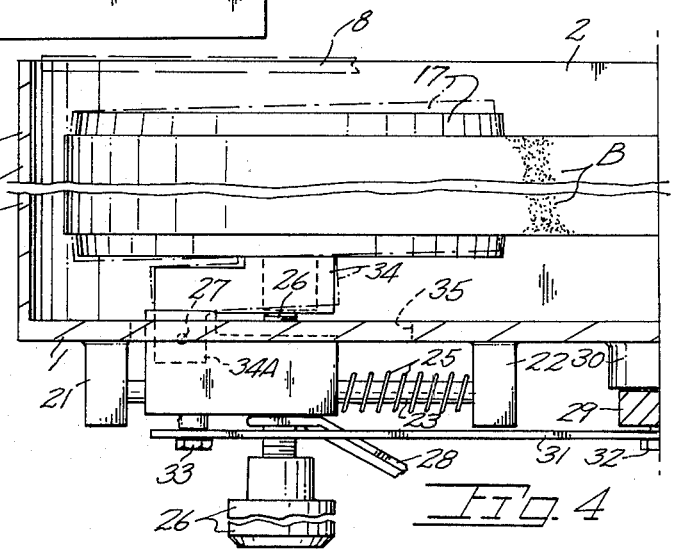
FIG. 4 is an enlarged sectional view taken downwardly along line 4—4 of FIG. 3.

As best viewed in FIG. 3, a tail roll release lever 29 is swingably mounted to the main body by means of a boss 30 formed thereon. A link 31 is pivotally coupled at 32 to said lever and coupled at 33 to block 24. Clockwise movement of lever 29 in FIG. 3 repositions block 24 from its normal operating position shown in FIG. 3 to the right or broken line position to simultaneously reposition tail roll 17 to a retracted, belt releasing position. Unlocking of lever 29 subsequent to belt replacement permits springs 25 to reposition block 24 and ultimately tail roll 17 to properly tension the belt. As earlier noted, tail roll 17 is slightly crowned as best shown in FIG. 4. A tail roll spindle at 34 is positionable about the upright axis of pivot means shown as an upright pin 27 extending through spindle carrier block 24 at a clevis-shaped end thereof and through an interposed end 34A of the spindle. An opening 35 in casting 2 receives spindle carrier block 24. Accordingly, advancement of adjustment screw 26 will impart inward movement to the spindle and tail roll thereon to reposition same to the broken line position of FIG. 4 for the purpose of centering belt B on the roll. Oppositely, retraction of adjustment screw 26 will permit spindle 34 and the tail roll to swing in an opposite or outward direction for like purposes. Once the adjustment screw is set, locking lever 28 is rotated thereby locking the screw shaft against rotational movement.

Driven output shaft 10 is suitably journalled within bearing means 40 carried on the inner side of cover plate 8. Said shaft extends outwardly through an opening in the plate to receive an abrading disk 41 disposed within a circular disk guard 42 formed integral with casting 8. Bosses as at 43 on said guard receive retention knobs 44 on which is supported a tool bed guard 45. A disk retaining nut is at 46. Removal of the knobs and said nut permit disk replacement.

While shown and described in place on electric motor 4, the elongate main body 1 may be otherwise mounted with motion being imparted to a driven shaft corresponding to motor output shaft 10. The arrangement shown is the preferred form in that the motor constitutes a stable support for main body 1 with resultant cost savings by dispensing with an independent support arrangement for main body 1.

As best viewed in FIG. 1, the forward side of the main body defines slot-like opening 9 at the right hand side of the main body which body permits lateral outward passage of a worn belt upon slackening of the belt by repositioning of the roll release lever 29. Similarly, abrading disk 41 is replaceable upon backing off of nut 46 and removal of tool bed 45 facilitated by removal of knob equipped fasteners 44.

For purposes of initially tensioning belt 12 boss 16 of head roll 14 may be moved fore or aft within an elongate opening in casting 2 as may fastener assemblies at 19 each of which also passes through fore and aft elongate opening in the casting. Drive wheel 14 is surfaced with a replaceable rubber tread 18 to assure non-slipping engagement with the belt inner surface.

In one embodiment of the machine the sanding disk 41 is of nine-inch diameter while belt B is two and one-half inches wide supported by surface 2A for a length of eighteen inches. Belt replacement entails only the repositioning of release lever 29 with the belt being removable via curved opening 9. The spring 25 assure proper belt tensioning and compensate for belt stretching.

The main body 1 may be horizontal as shown in FIG. 1 or slightly inclined so as to horizontally position tool bed 45.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. An abrading machine comprising, a power output shaft driven by a power source, a main body of elongate configuration having a belt supporting surface, a powered roll mounted on said main body adjacent one end thereof, power transmission means coupling said power output shaft and said powered roll, a tail roll located adjacent the remaining end of said main body, an abrading belt on the rolls and having one run superposed on said belt supporting surface of said main body, a tail roll mounting assembly on said main body including a spindle carrier block, resilient means biasing said spindle carrier block toward a belt tensioning position, a spindle carried by said block on which said tail roll is mounted, upright pivot means coupling said spindle to the spindle carrier block, a spindle adjustment screw carried by said block and acting on said spindle to position same about said upright pivot means for purposes of centering the abrading belt on the tail roll during belt travel, and an abrading disk mounted on the outer end of said output shaft.

2. The machine claimed in claim 1 wherein said tail roll mounting assembly additionally includes a lock for securing said screw against rotation.

3. The machine claimed in claim 1 wherein said tail roll mounting assembly additionally includes a tail roll release lever, a link coupling said lever to the spindle carrier block whereby manual movement of the lever will reposition the spindle carrier against the action of said resilient means to a retracted locked position to release tension on the belt to facilitate belt replacement.

4. The machine claimed in claim 3 wherein said power output shaft is the motor shaft of an electric motor, said elongate main body secured to said motor, said abrading disk on said shaft and laterally offset from the abrading belt.

5. The machine claimed in claim 2, 3, 4 or 1 wherein said main body includes a raised portion at one end thereof and a cover plate, said raised portion and said cover plate defining an opening laterally offset from the belt and permitting lateral belt passage outwardly therethrough during belt removal.

* * * * *